US006630798B2

(12) United States Patent
Motomura et al.

(10) Patent No.: US 6,630,798 B2
(45) Date of Patent: Oct. 7, 2003

(54) ELECTRONIC FLASH DEVICE OF AUTOMATIC LIGHT ADJUSTING TYPE

(75) Inventors: Katsumi Motomura, Asaka (JP); Takeshi Kubota, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/135,504

(22) Filed: May 1, 2002

(65) Prior Publication Data

US 2002/0171372 A1 Nov. 21, 2002

(30) Foreign Application Priority Data

May 2, 2001 (JP) ..... 2001-135429

(51) Int. Cl.[7] ..... H05B 41/00

(52) U.S. Cl. ..... 315/241 P; 315/241 S; 396/159

(58) Field of Search ..... 315/241 P, 241 S; 396/159

(56) References Cited

U.S. PATENT DOCUMENTS 3,783,336 A 1/1974 Vital et al.
3,809,951 A 5/1974 Vital et al.
3,818,266 A 6/1974 Vital et al.
3,857,064 A 12/1974 Vital et al.
3,992,643 A 11/1976 Vital et al.
4,164,686 A 8/1979 Vital et al.
5,747,944 A * 5/1998 Harada ..... 315/241 P

* cited by examiner

*Primary Examiner*—David Vu
(74) *Attorney, Agent, or Firm*—Young & Thompson

(57) ABSTRACT

An electronic flash device of an automatic light adjusting type includes a main capacitor for storing charge at a high voltage. A flash discharge tube generates flash light upon discharging the main capacitor therewith. A light adjusting circuit adjusts a light amount of the flash light by feedback. The light adjusting circuit includes a reflected light measuring unit for outputting an integration voltage for representing a light amount of reflected light from a photographic field illuminated with the flash light. A thyristor as non-contact switch short-circuits terminals of the main capacitor upon being turned on, to quench emission of the flash light in the flash discharge tube. A turn-on capacitor is charged by a current of discharge in response to the emission of the flash light, and is discharged when the integration voltage comes up to a prescribed level, to turn on the thyristor responsively. A control transistor keeps the reflected light measuring unit disabled while the turn-on capacitor is initially charged, and enables the reflected light measuring unit after the integration voltage comes up to a predetermined level.

14 Claims, 10 Drawing Sheets

ELECTRONIC FLASH DEVICE OF AUTOMATIC LIGHT ADJUSTING TYPE

BACKGROUND OF THE INVENTION

1. Field of the Invention

The present invention relates to an electronic flash device of an automatic light adjusting type. More particularly, the present invention relates to an electronic flash device of an automatic light adjusting type in which flash light can be automatically adjusted without an error in the adjustment.

2. Description Related to the Prior Art

A lens-fitted photo film unit is known, in which a housing is pre-loaded with unexposed photo film and which includes a taking lens, a shutter device and other relevant elements. There is a flash type of lens-fitted photo film unit in which a flash device is incorporated for applying flash light to a photographic object to be taken typically at night or indoors. The flash device in the available type of the lens-fitted photo film unit applies flash light at a predetermined amount irrespective of an object distance. In a close-up photography, there arises a problem of an overexposure of a principal object due to a very near distance. The principal object is likely to be photographed in a whitish manner as viewed in a print produced from the frame. Even if the principal object is reproduced with suitable density, a background image is likely to be too dark.

An auto flash device is known as a flash device of an automatic flash emitting type. In the auto flash device, a flash discharge tube emits flash light. The photographic field reflects the flash light, which is received by a photoreceptor element. A photoelectric current is obtained by the photoreceptor element, and integrated. When the result of the integration reaches a predetermined level, a non-contact switch such as a thyristor is changed over, to discontinue the discharge of the main capacitor. The flash emission of the flash discharge tube is quenched. Thus, the light amount of the flash light is optimized.

JP-B 52-047327 (corresponding to U.S. Pat. Nos. 3,783,336, 3,809,951, 3,818,266, 3,857,064, 3,992,643 and 4,164,686) discloses a construction for preventing errors in operation of a light adjusting circuit due to influence of unrelated light, for example, light from other flash Devices. In FIG. 10, the flash device includes a main capacitor 80, a light adjusting circuit 81 and a power source circuit 83. A capacitor 82 in the light adjusting circuit 81 is charged by the power source circuit 83 together with the main capacitor 80. When a trigger voltage is applied by a trigger circuit 84 to a flash discharge tube 85, the main capacitor 80 is discharged in a path with the flash discharge tube 85, which emits flash light.

At the same time as the start of flash emission, the capacitor 82 starts being discharged in a path with the flash discharge tube 85, a Zener diode 86 and a resistor 87. Voltage generated across the Zener diode 86 is applied to the light adjusting circuit 81 which starts operation. A photo diode 88 receives and reflected flash light from the object. An integration capacitor 89 stores charge according to the light amount of the reflected flash light at the photo diode 88. When the charged voltage across the integration capacitor 89 reaches a predetermined level, a UJT (unijunction transistor) 90 is turned on. A turn-on capacitor 91 is responsively discharged in a path with a resistor 92. Voltage generated across the resistor 92 is applied to a gate of a thyristor 93. The thyristor 93 is turned on, to discharge the main capacitor 80 in a path with the thyristor 93. The flash emission is quenched.

Should another flash device happen to exist beside the camera, the light adjusting circuit 81 is likely to receive influence of the external flash device, to turn on the thyristor 93. The main capacitor 80 may be discharged accidentally without any purpose. However, the construction according to the prior art can prevent such a problem, because the light adjusting circuit 81 operates at the same time as the start of flash emission.

However, there are several problems in the construction in the above document. Failure is likely to occur in the automatic light adjustment specifically when the object distance is a very near distance, or when a photographic object has a very high reflectance. Flash light is emitted in full emission without restriction, to result in an overexposure. The turn-on capacitor 91, which starts being charged simultaneously with the flash emission, has the voltage coming up to a level enough for turning on the thyristor 93. The failure occurs when the UJT 90 is turned on by an increase of the integration capacitor 89 before the voltage across the turn-on capacitor 91 comes up to the level enough for turning on the thyristor 93. This is because a light amount of reflected flash light is remarkably high.

A photo transistor is used as photoreceptor element. When the voltage is applied to the photo transistor as effective voltage for light detection, the photo transistor outputs a current in amplification of a current input to the photo transistor because of junction capacitance. The integration capacitor 89 is charged by the current after the amplification. A problem arises, as it is likely that the flash emission is quenched earlier than it should be. The precision in the light adjustment is lower.

SUMMARY OF THE INVENTION

In view of the foregoing problems, an object of the present invention is to provide an electronic flash device of an automatic light adjusting type in which flash light can be automatically adjusted without an error in the adjustment.

In order to achieve the above and other objects and advantages of this invention, an electronic flash device of an automatic light adjusting type includes a main capacitor for storing charge at a high voltage, a flash discharge tube for generating flash light upon discharging the main capacitor therewith, and a light adjusting circuit for adjusting a light amount of the flash light by feedback. In the flash device, the light adjusting circuit includes a reflected light measuring unit for outputting an integration voltage for representing a light amount of reflected light from a photographic field illuminated with the flash light. A non-contact switch short-circuits terminals of the main capacitor upon being turned on, to quench emission of the flash light in the flash discharge tube. A turn-on capacitor is charged by a current of discharge in response to the emission of the flash light, and is discharged when the integration voltage comes up to a prescribed level, to turn on the non-contact switch responsively. A control switching element keeps the reflected light measuring unit disabled while the turn-on capacitor is initially charged, and enables the reflected light measuring unit after voltage across the turn-on capacitor comes up to a predetermined level.

Consequently, full emission of flash light can be prevented specifically for photography at a very near distance.

Furthermore, a discharge switching unit is connected in parallel with the turn-on capacitor, for being turned on when the integration voltage from the reflected light measuring unit comes up to the prescribed level, to discharge the turn-on capacitor.

The reflected light measuring unit includes a photo transistor, supplied with electric power by the control switching element, for outputting a photoelectric current proportional to intensity of the reflected light incident thereon. There is an integration capacitor for integration of the photoelectric current to output the integration voltage.

Furthermore, a bypass switching element is turned on in response to becoming conductive of the control switching element, and short-circuits terminals of the integration capacitor until lapse of a predetermined time, to inhibit charging with the photoelectric current.

Consequently, flash light can be automatically adjusted without an error in the adjustment.

The bypass switching element is a bypass transistor, having a collector and emitter connected with respectively electrodes of the integration capacitor, and a base connected with the control switching element. Furthermore, a capacitor is connected between the base of the bypass transistor and the control switching element, and adapted for determining the predetermined time at which on-voltage is applied to the base of the bypass transistor.

The reflected light measuring unit includes a near distance compensation resistor, connected in series with the integration capacitor, for constituting a serial circuit, to correct the integration voltage if the integration voltage increases slowly and highly, the serial circuit generating the integration voltage at a corrected level.

Furthermore, an effective voltage generator outputs increasing power source voltage when the main capacitor is discharged. The turn-on capacitor is supplied with the power source voltage, and charged.

The effective voltage generator includes a power supply capacitor, connected in parallel with the main capacitor and the flash discharge tube, for being charged and discharged together with the main capacitor, the power supply capacitor outputting an increasing power supply voltage upon being discharged. A Zener diode is connected with the power supply capacitor, for limiting the power supply voltage from the power supply capacitor to at least a predetermined effective voltage. When the increasing power supply voltage comes up to the predetermined effective voltage, the control switching element is rendered conductive in response to an output of the Zener diode, for applying the power supply voltage to the reflected light measuring unit.

The non-contact switch is a thyristor having an anode and cathode connected with respectively electrodes of the flash discharge tube, and having a gate connected with the turn-on capacitor.

Furthermore, a current limiting resistor is connected between the power supply capacitor and the Zener diode, for limiting a current from the power supply capacitor.

In a preferred embodiment, the power supply capacitor is connected in parallel with the main capacitor and the flash discharge tube at a connection point Pd. The Zener diode is connected in parallel with the turn-on capacitor. Furthermore, a choke coil is connected between the main capacitor and the connection point Pd, for constituting a first serial circuit with the main capacitor, wherein a current flows in the choke coil during the flash emission of the flash discharge tube by discharging the main capacitor, there occurs back electromotive force in the choke coil, for lowering a voltage between terminals of the first serial circuit, and for lowering a voltage between terminals of a second serial circuit including the power supply capacitor and the Zener diode, to discharge the power supply capacitor to charge the turn-on capacitor.

In another preferred embodiment, furthermore, a level changer sets the prescribed level variable for the integration voltage, to determine the light amount of the flash light to be emitted before quench.

The level changer has an offset voltage generator, including a first resistor and a variable resistor connected in series therewith, for generating an offset voltage by dividing the power supply voltage according to resistance of the variable resistor. An adjustment transistor is supplied with input voltage, for becoming conductive when the input voltage comes up to a predetermined voltage, the input voltage being lower than the integration voltage by the offset voltage.

The adjustment transistor has a collector and emitter one of which is supplied with the offset voltage. Furthermore, an effective voltage generator applies the power supply voltage to the light adjusting circuit. A capacitor is connected with the one of the collector and emitter in parallel with the effective voltage generator and the first resistor, for absorbing electric noise to prevent the adjustment transistor from erroneously becoming conductive.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
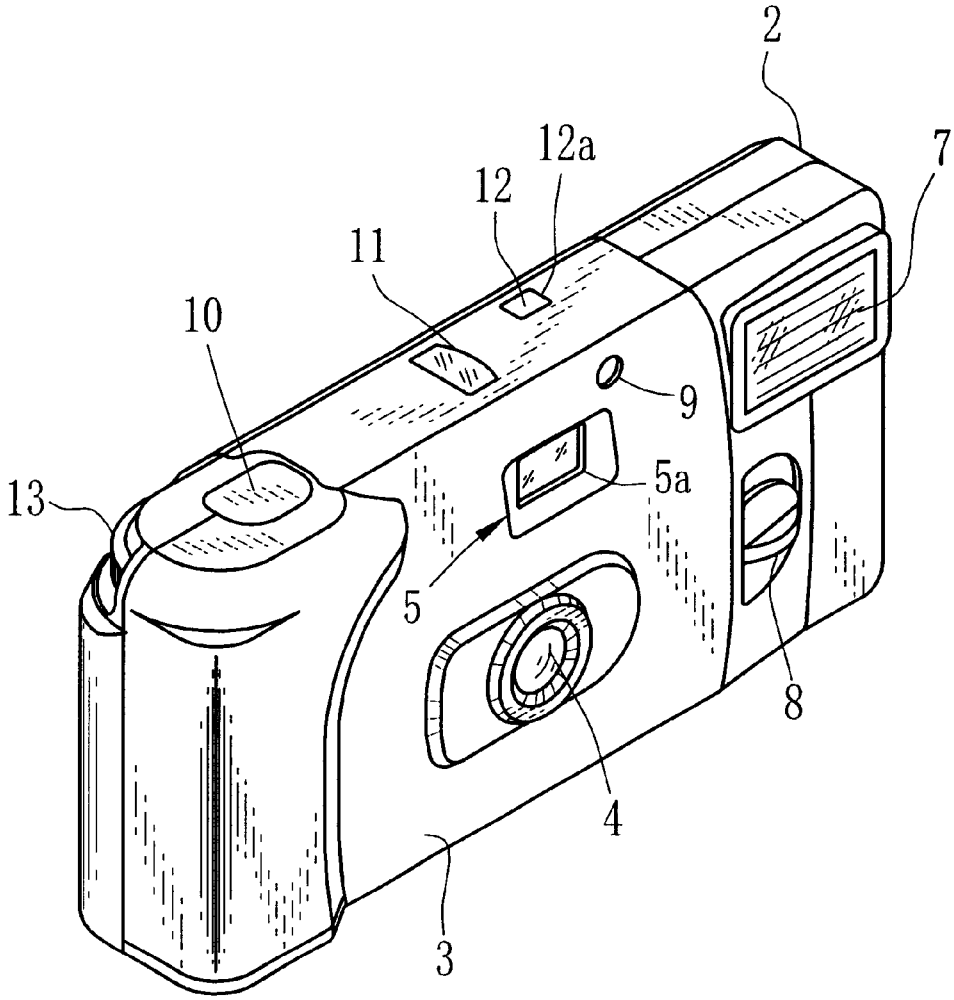
FIG. 1 is a perspective illustrating a lens-fitted photo film unit.

In FIG. 1, a lens-fitted photo film unit is illustrated. A housing 2 has a sticker belt 3 fitted partially on a surface of the housing 2. Various mechanisms for taking an exposure are incorporated in the housing 2 pre-loaded with a photo film cassette. An electronic flash device of an automatic light adjusting type is incorporated in the lens-fitted photo film unit.

A front wall of the housing 2 has a taking lens 4, an objective window 5*a* of a viewfinder 5, a flash emitter 7, a flash charger button 8, and a light receiving window 9 for flash light adjustment. The flash emitter 7 of an electronic flash device emits flash light toward a photographic field. An upper wall of the housing 2 has a shutter release button 10, a frame counter 11 and an opening 12*a*. The frame counter 11 indicates the number of remaining available frames. The opening 12*a* is adapted to protrusion of a light guide 12, which indicates completion of the charged state. A winder wheel 13 appears in a rear wall of the housing 2, and is rotated for each one frame to be exposed. An eyepiece window (not shown) of the viewfinder 5 is disposed directly behind the objective window 5*a*. The sticker belt 3 is attached to the center of the housing 2, and includes a number of openings in which various elements appear externally, including the taking lens 4, the viewfinder 5, the frame counter 11 and the like.

The flash charger button 8 is linked with a charger power switch for the flash device. When the flash charger button 8 is slid up and set in an ON position, the charger power switch is turned on to start charging. After the charging, the shutter release button 10 is depressed with the flash charger button 8 kept in the ON position. An exposure is taken, in synchronism with which the flash emitter 7 emits flash light toward a photographic field. When the flash charger button 8 is slid down and set in an OFF position as depicted in the drawing, emission of flash light is disabled. The light guide 12 is linked with the flash charger button 8. When the flash charger button 8 is set in the ON position, the light guide 12 becomes protruded over the upper surface of the housing 2.

Figure 3:
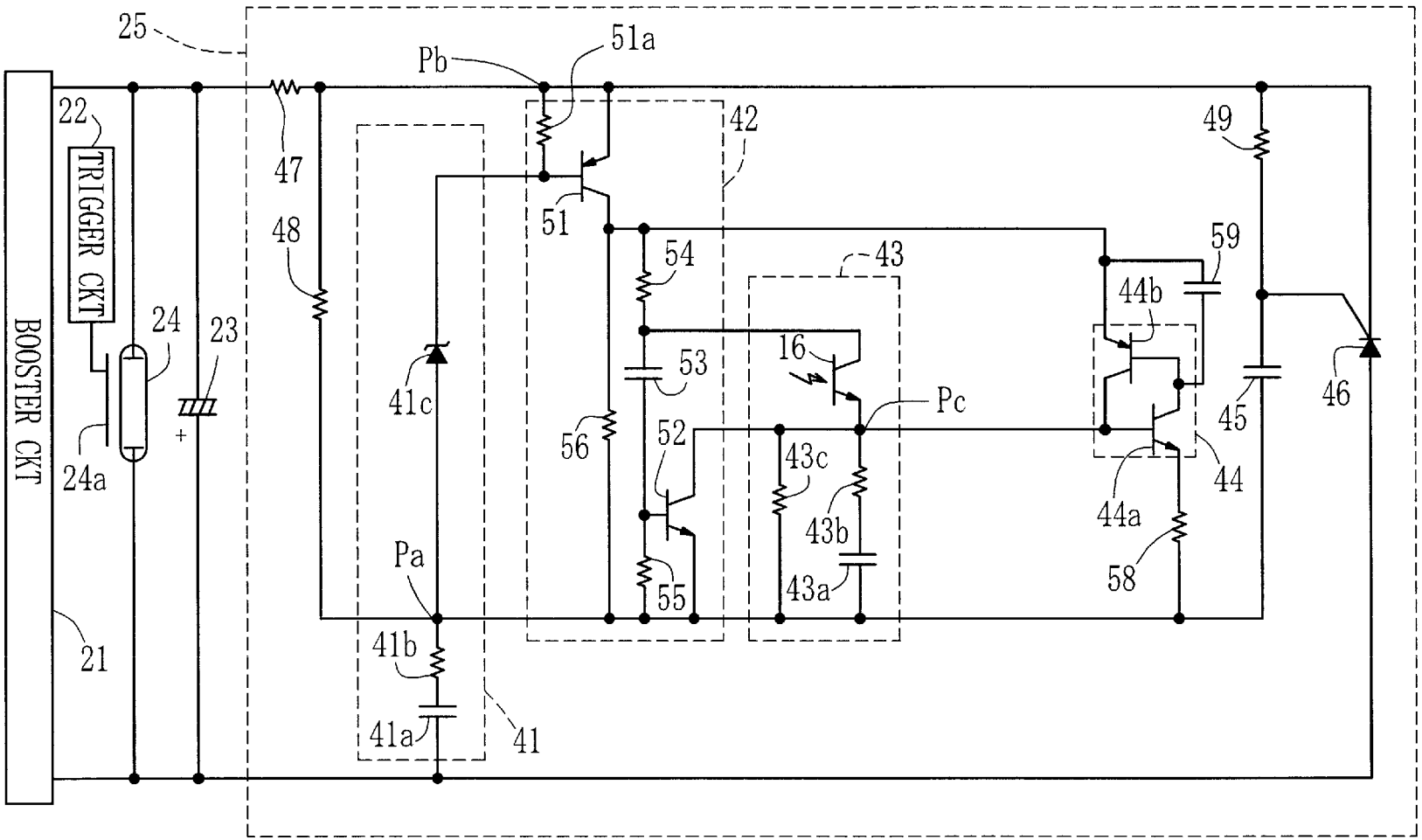
FIG. 3 is a block diagram illustrating a light adjusting circuit with relevant elements in the flash device.

In FIG. 3, a photo transistor 16 is disposed in a position behind the light receiving window 9. Upon emission of flash light, the photo transistor 16 receives reflected flash light from a photographic field to adjust an amount of flash light.

Figure 2:
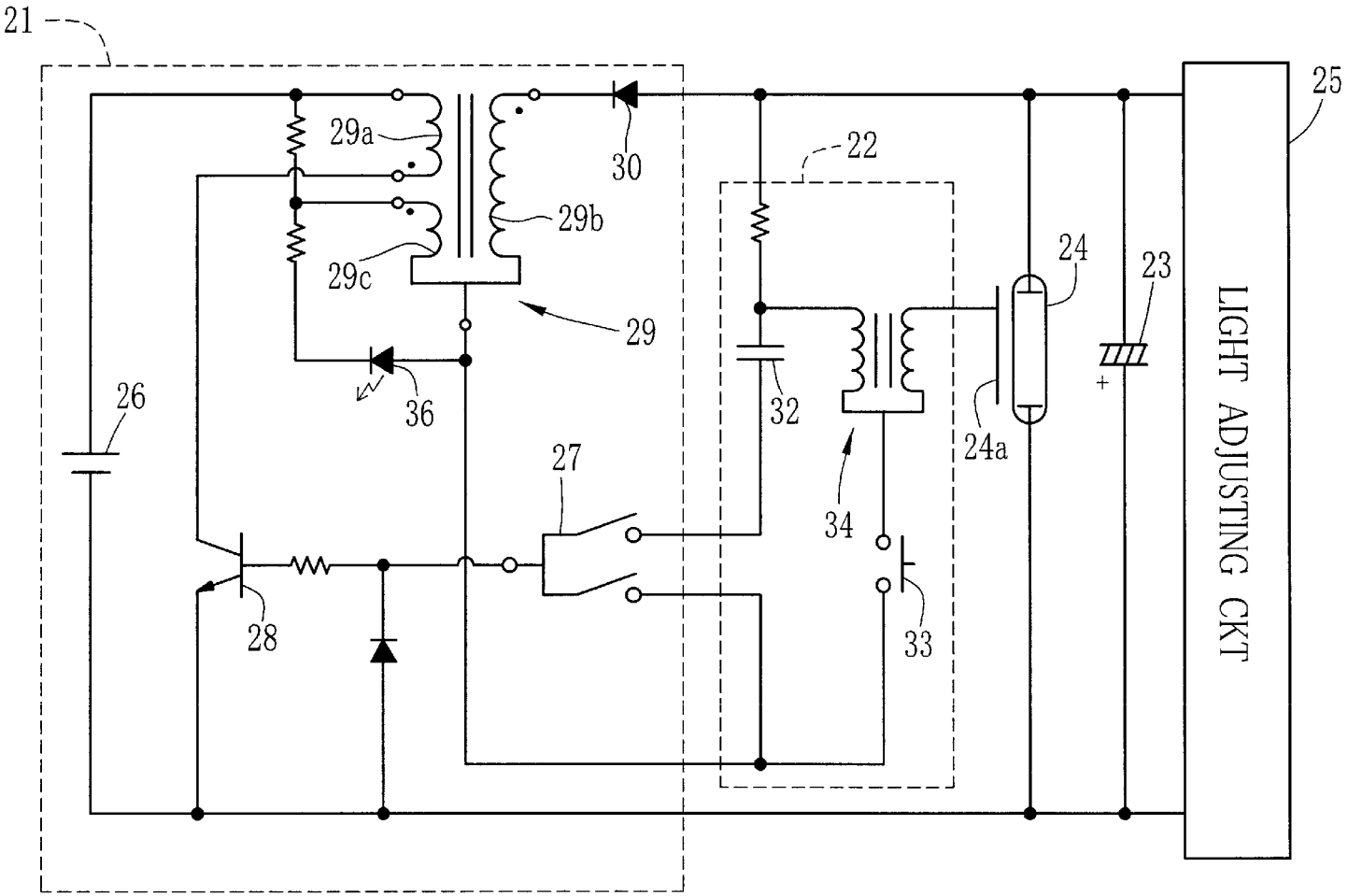
FIG. 2 is a block diagram illustrating a flash circuit in an electronic flash device.

In FIG. 2, circuits of the flash device are illustrated. The flash device includes a booster circuit 21, a trigger circuit 22, a main capacitor 23, a flash discharge tube 24, and a light adjusting circuit 25. A battery 26 supplies power to the booster circuit 21.

The booster circuit 21 includes a charger power switch 27, an oscillation transistor 28, an oscillation transformer 29 and a rectification diode 30. The oscillation transistor 28 and the oscillation transformer 29 constitute a blocking oscillator for converting a power source voltage of the battery 26 into high voltage to charge the main capacitor 23.

When the flash charger button 8 is set in the ON position, the charger power switch 27 is turned on. The blocking oscillator circuit is energized while the charger power switch 27 is kept turned on. In a primary winding 29*a* of the oscillation transformer 29 on an input side, a current flows with an increase and decrease. According to the increase and decrease of the current, there occurs high voltage of an alternate current in a secondary winding 29*b*. The rectification diode 30 rectifies the alternate current from the secondary winding 29*b*.

The main capacitor 23 is connected with output terminals of the booster circuit 21, which are an emitter of the oscillation transistor 28 and an anode of the rectification diode 30. The main capacitor 23 is charged up to high voltage by an current output by the booster circuit 21. The main capacitor 23 is charged in a minus charging manner, in which a potential of a positive terminal is kept constant at the sign "+" in the drawing, and a potential of a negative terminal is lowered on a side of an anode of the rectification diode 30.

Terminals of the main capacitor 23 are connected with respectively electrodes of the flash discharge tube 24. The flash discharge tube 24 is disposed in the flash emitter 7. A trigger electrode 24*a* of the flash discharge tube 24 is supplied with trigger voltage, so breakdown occurs between the insulated electrodes of the flash discharge tube 24. Charge stored in the main capacitor 23 is discharged between the electrodes of the flash discharge tube 24, to emit flash light.

The trigger circuit 22 includes a trigger capacitor 32, a sync switch 33 and a trigger transformer 34. The trigger capacitor 32 is charged by a current output by the booster circuit 21 in a manner similar to the main capacitor 23. When a shutter blade (not shown) is opened and shut, the sync switch 33 is turned on and off in synchronism therewith. While the charger power switch 27 is turned on, the shutter blade opens fully to turn on the sync switch 33. Thus, the trigger capacitor 32 causes a current of the discharge to flow to a primary winding of the trigger transformer 34. In response to the flow of the current in the primary winding, a secondary winding in the trigger transformer 34 generates a trigger voltage of approximately 4 kV, and applies the trigger voltage to the flash discharge tube 24 through the trigger electrode 24*a*. Accordingly, flash light starts being emitted when the shutter blade opens fully.

To indicate the completion of charging the main capacitor 23, a light-emitting diode (LED) 36 is connected between terminals of a tertiary winding 29*c* of the oscillation transformer 29. According to an increase in the charged voltage of the main capacitor 23, a potential difference between the terminals of the tertiary winding 29*c* increases. When the main capacitor 23 becomes charged to a predetermined level of the charging voltage, the LED 36 is caused to emit light during operation of the blocking oscillator circuit. The LED 36 is disposed in a position opposed to a lower surface of the light guide 12. Light from the LED 36 is guided by the light guide 12 to the outside, and is observed by a user of the lens-fitted photo film unit, and is checked for the completion of the charging.

In FIG. 3, the light adjusting circuit 25 is depicted, and includes an effective voltage generator 41, a light receiving control unit 42, a reflected light measuring unit 43, a discharge switching unit 44, a turn-on capacitor 45, and a tripolar type of thyristor or SCR (silicon controlled rectifier) 46 as non-contact switch. The light adjusting circuit 25 is connected in parallel with the flash discharge tube 24 with reference to the main capacitor 23. For this connection, only pins of the terminals of the main capacitor 23 are fastened and connected to the light adjusting circuit 25. This is effective in adding the flash light adjusting operation without changes in elements basically constituting the flash device of the conventional type.

The effective voltage generator 41 is constituted by a power supply capacitor 41*a*, a current limiting resistor 41*b* and a Zener diode 41*c*. One terminal of the power supply capacitor 41*a* is connected with a positive terminal of the main capacitor 23. A remaining terminal of the power supply capacitor 41*a* is connected with one end portion of the current limiting resistor 41*b*. A remaining end portion of the current limiting resistor 41*b* is connected with an anode of the Zener diode 41*c*. A cathode of the Zener diode 41*c* is connected with a negative terminal of the main capacitor 23 by means of a resistor 51*a* in the light receiving control unit 42 and a resistor 47. Note that there are plural resistor elements in series to constitute the current limiting resistor 41*b* for the purpose of determining or adjusting a resistance level or rating. It is also noted that the resistor 47 can be omitted, and the resistor 51*a* may be connected with the main capacitor 23 directly.

While the main capacitor 23 is charged, the power supply capacitor 41*a* is also charged by a current output from the booster circuit 21 up to a charging voltage the same as that of the main capacitor 23 in a manner to lower a potential on the side of the current limiting resistor 41*b*. When the main capacitor 23 starts being discharged in a path with the flash discharge tube 24, the power supply capacitor 41*a* is also discharged in the path with the flash discharge tube 24. A power supply voltage Vab is generated between connection points Pa and Pb for powering the light receiving control unit 42, the reflected light measuring unit 43, the turn-on capacitor 45, and the discharge switching unit 44. The power supply voltage Vab is so generated as to provide higher voltage at the connection point Pb.

A current from the power supply capacitor 41*a* upon the discharge flows through the flash discharge tube 24 and the resistor 47, and is supplied for the purpose of operating the light receiving control unit 42, the reflected light measuring unit 43, the turn-on capacitor 45, and the discharge switching unit 44. Immediately after flash emission, the current from the power supply capacitor 41*a* flows in a path including the flash discharge tube 24, the resistor 47, a resistor 49, the turn-on capacitor 45 and the current limiting resistor 41*b* and back to the power supply capacitor 41*a*, so as to charge the turn-on capacitor 45. The power supply capacitor 41*a* supplies power at a power supply voltage Vab, which gradually increases according to the process of charging of the turn-on capacitor 45.

The current limiting resistor 41*b* is effective in the process required for the light adjustment, and limits a current of discharge of the power supply capacitor 41*a*, to obtain the power supply voltage Vab required for operating the light receiving control unit 42, the reflected light measuring unit 43, the turn-on capacitor 45, and the discharge switching unit 44, by continuing the discharge of the power supply capacitor 41*a*.

The Zener diode 41*c* is connected for the purpose of limiting the power supply voltage Vab to the effective voltage V1. The power supply voltage Vab increases and comes up to the voltage V1=VON+VZD, which is a sum of the Zener voltage VZD and a voltage VON, which is an emitter-base voltage required for rendering conductive a control transistor 51 in the light receiving control unit 42 as control switching element. Upon the reach to the voltage V1, a Zener current flowing in the Zener diode 41*c* becomes constant, flowing via the resistor 51*a* connected between the emitter and base of the control transistor 51. The resistance of the resistor 51*a* is so determined that a constant current flowing in the resistor 51*a* causes a clip voltage of the Zener diode 41*c* to be a predetermined level when the control transistor 51 becomes conductive. Therefore, the voltage between electrodes of the Zener diode 41*c* is kept constant at the Zener voltage VZD. The power supply voltage Vab is kept at the voltage V1. Note that the Zener voltage VZD is 5.6 volts in the present embodiment. The voltage VON is 0.7 volt. The voltage V1 is 6.3 volts.

A resistor 48 is connected between the connection point Pa of the Zener diode 41*c* and the connection point Pb. The resistor 48 operates upon full emission of flash light at the end of the emission without rendering the thyristor 46 conductive, and discharges the remaining charge in the turn-on capacitor 45 for initialization of the turn-on capacitor 45.

The light receiving control unit 42 includes the control transistor 51, the resistor 51*a*, a bypass transistor 52 as bypass switching element, a capacitor 53, resistors 54 and 55 and an initialization resistor 56. The control transistor 51 is a p-n-p transistor, has an emitter connected with the connection point Pb, has a base connected with a cathode of the Zener diode 41*c*. A collector of the control transistor 51 is connected with a collector of the photo transistor 16 by the resistor 54. The control transistor 51 is an element connected in a path for supply of power to the reflected light measuring unit 43 at the power supply voltage Vab.

The control transistor 51 is used for powering the reflected light measuring unit 43 after the charging voltage VT across the turn-on capacitor 45 comes up to at least the voltage V2 required for turning on the thyristor 46, or after the power supply voltage Vab comes up to the effective voltage V1. The control transistor 51 is rendered conductive between an emitter and collector when the power supply voltage Vab comes up to the threshold voltage V1. When the control transistor 51 becomes conductive, the power supply voltage Vab=V1 is applied to the collector of the photo transistor 16 in a path with the control transistor 51 and the resistor 54.

The resistor 51*a* prevents the control transistor 51 from being turned on by a low current flowing in the Zener diode 41*c* before the power supply voltage Vab comes up to the voltage V1, for the purpose of maintaining precision in the light adjustment. The resistor 51*a* is connected between the emitter and base of the control transistor 51.

Note that the Zener diode 41*c* is included in the effective voltage generator 41. The control transistor 51 and the resistor 51*a* are included in the light receiving control unit 42. However, the power supply voltage Vab with which the control transistor 51 becomes conductive depends upon a Zener voltage VZD of the Zener diode 41*c*. Turning on of the control transistor 51 keeps the power supply voltage Vab at the voltage V1. Accordingly, the Zener diode 41*c* operates also as a portion of the control transistor 51. The control transistor 51 and the resistor 51*a* operate also as portions of the effective voltage generator 41.

The capacitor 53 has a first terminal connected with a connection point between the resistor 54 and a collector of the photo transistor 16, and a second terminal connected with the connection point Pa via the resistor 55. The bypass transistor 52 is an n-p-n transistor, of which a base is connected with a connection point between the capacitor 53 and the resistor 55, and an emitter is connected with the connection point Pa. A collector of the bypass transistor 52 is connected with an emitter of the photo transistor 16.

When the control transistor 51 is rendered conductive, a collector current in the control transistor 51 partially flows to charge the capacitor 53, and flows to the resistor 55. A voltage is generated across the resistor 55, and renders conductive a collector and emitter of the bypass transistor 52. In the reflected light measuring unit 43, an integration capacitor 43*a* and a near distance compensation resistor 43*b* are provided. The bypass transistor 52 short-circuits terminals of the integration capacitor 43*a*, or more precisely short-circuits terminals of a serial circuit including the integration capacitor 43*a* and the near distance compensation resistor 43*b*. In the process of charging the capacitor 53, the bypass transistor 52 is turned off when a voltage across the resistor 55 comes down to a threshold voltage.

This being so, the bypass transistor 52 is conductive for a predetermined time after turning on of the control transistor 51, namely, after application of the voltage to the photo transistor 16. Therefore, inrush current is caused to flow in the bypass transistor 52, the inrush current being a current output by the emitter because of a collector output capacitance (Cob) of the photo transistor 16 immediately after the control transistor 51 is turned on. The integration of a light amount in the reflected light measuring unit 43 can be effected in a precise manner.

The collector output capacitance is capacitance existing between a collector and base of the photo transistor 16 at a considerable level. When the collector voltage is applied to the photo transistor 16, a current flows into the base because of the collector output current. In the photo transistor 16, the base current is amplified to output an inrush current at an appreciable level from the emitter.

Time of turning on the bypass transistor 52 can be adjusted by changing the capacitance of the capacitor 53 or resistance of the resistors 54 and 55, and should be determined as the longest time of flow of inrush current. Time of flow of inrush current changes according to a charging state of the collector output capacitance. So it is preferable to obtain the longest time of flow of inrush current experimentally, and to determine the time of turning on the bypass transistor 52.

A current of the discharge from the power supply capacitor 41*a* is limited by the current limiting resistor 41*b* connected with the power supply capacitor 41*a*. A high current at a collector of the control transistor 51 slightly lower than the current upper limit may occur in a form of an inrush current, and flows into the control transistor 51. So it is likely that relatively high voltage, for example 1 volt, which is higher than a normal voltage, is applied between an emitter and collector of the control transistor 51. Operation of the light adjusting circuit 25 may be unstable, to lower precision in the light adjustment. It is necessary to adjust constants of the current limiting resistor 41*b*, the resistor 54, the capacitor 53 and the like to prevent a very high current at the collector from flowing. Note that it is possible to select a type of the power supply capacitor 41*a* with a high capacitance, to determine a high level of a current of the discharge from the power supply capacitor 41*a*.

The initialization resistor 56 operates for initialization by discharging the capacitor 53, and is connected between a collector of the control transistor 51 and the connection point Pa. When the control transistor 51 is turned off, the capacitor 53 is discharged through a path with the initialization resistor 56, and is initialized.

The reflected light measuring unit 43 includes the photo transistor 16, the integration capacitor 43*a*, the near distance compensation resistor 43*b* and an initialization resistor 43*c*. The photo transistor 16 is disposed behind the light receiving window 9 in the housing 2, and receives reflected flash light from a photographic object. A collector of the photo transistor 16 is connected with a collector of the control transistor 51 by the resistor 54. The near distance compensation resistor 43*b* and the integration capacitor 43*a* are serially connected between the emitter of the photo transistor 16 and the connection point Pa in a sequence from the emitter. Note that a photo diode or the like, as photo receptor element, may be used instead of the photo transistor 16.

The photo transistor 16 generates a photoelectric current according to an amount of received light, as the collector of the photo transistor 16 is supplied with the constant power supply voltage Vab in a path with the control transistor 51 and the resistor 54 during flash emission. The integration capacitor 43*a* is charged by the current from the photo transistor 16 in a path with the near distance compensation resistor 43*b*. Therefore, intensity of the light received by the photo transistor 16 is subjected to integration in the integration capacitor 43*a* to obtain the light amount. The reflected light measuring unit 43 outputs the integration voltage Vac as light amount after the integration according to a potential difference between the connection points Pa and Pc, namely a sum of a voltage across the near distance compensation resistor 43*b* and the charged voltage across the integration capacitor 43*a*. The direction of the integration voltage Vac is such that a potential of the connection point Pc is higher. To be precise, the photo transistor 16 receives ambient light in addition to flash light, and generates the photoelectric current according to the sum of light.

The near distance compensation resistor 43*b* is used for raising precision in the light adjustment typically when an object distance of a principal object is small. There is a delay before turning on of the thyristor 46 after the turning on of the discharge switching unit 44 upon a reach of the integration voltage Vac, as will be described later. When an object distance is small in contrast, reflected flash light has high intensity. Even if there is a small delay in quenching the flash emission, there occurs a considerable increase in an exposure amount due to an increase in the light amount of the flash light.

However, the use of the near distance compensation resistor 43*b* causes the integration voltage Vac to be higher than the lack of the near distance compensation resistor 43*b* by a value of the voltage across the near distance compensation resistor 43*b* according to a flow of a photoelectric current. Turning on of the discharge switching unit 44 can be set earlier in such a manner as to compensate for a delay before discontinuation of flash emission. As a result, precision in light adjustment can be higher specially at the time of near distance photography. Note that a photoelectric current flowing in the near distance compensation resistor 43*b* is low when an object distance is very long. The voltage across the near distance compensation resistor 43*b* becomes lower. Turning on of the discharge switching unit 44 does not become much earlier. However, there is no problem, because reflected flash light is relatively weak. Small changes in an amount of the flash light only cause small changes in an exposure amount.

The initialization resistor 43*c* is connected in parallel with a series of the near distance compensation resistor 43*b* and the integration capacitor 43*a*. After the control transistor 51 is turned off, the initialization resistor 43*c* initializes the integration capacitor 43*a* by discharge.

The discharge switching unit 44 includes a first and second transistors 44*a* and 44*b*. The first transistor 44*a* is an n-p-n transistor, has a base connected with the connection point Pc. An emitter of the first transistor 44*a* is connected with the connection point Pa in a path with a resistor 58. The integration voltage Vac is applied between base and emitter in the path with the resistor 58 at a level according to the integration value of the received light amount.

The second transistor 44*b* is an p-n-p transistor, has an emitter connected with a collector of the control transistor 51, a collector connected with a base of the first transistor 44*a*, and a base connected with a collector of the first transistor 44*a*. A noise absorbing capacitor 59 prevents the discharge switching unit 44 from becoming conductive even upon occurrence of electric noise. Note that a resistor (not shown) may be used in place of the noise absorbing capacitor 59.

According to the above-described connection, the first transistor 44*a* becomes conductive between the emitter and collector upon the reach of the integration voltage Vac to a threshold voltage V3. In response to this, the power supply voltage Vab is applied to an emitter of the second transistor 44*b* in a path with the control transistor 51. A current flows to the base of the second transistor 44*b* which becomes conductive. Upon rendering the second transistor 44*b* conductive, the power supply voltage Vab is applied to a base of the first transistor 44*a* in a path with the control transistor 51 and the second transistor 44*b*. A current flows to the base of the first transistor 44*a*. Once the first transistor 44*a* becomes conductive by application of the integration voltage Vac, the first and second transistors 44*a* and 44*b* remain conductive before the control transistor 51 is turned off even if the integration voltage Vac drops. Thus, a conductive state of the discharge switching unit 44 continues.

Note that the discharge switching unit may be constituted only by the first transistor 44*a*. However, the combination of the second transistor 44*b* with the first transistor 44*a* makes it possible with reliability to rendering the thyristor 46 conductive, because sufficient time can be taken for discharging the turn-on capacitor 45.

One terminal of the turn-on capacitor 45 is connected with one end portion of the resistor 49. A second terminal of the turn-on capacitor 45 is connected with the connection point Pa. A second end portion of the resistor 49 is connected with the connection point Pb. When flash emission is started, the turn-on capacitor 45 is charged by a flow of a current from the power supply capacitor 41*a* through the resistor 49. As the turn-on capacitor 45 is connected between the connection points Pa and Pb, the charging voltage VT of the turn-on capacitor 45 comes up and becomes the voltage V1 at the highest.

A current for charging the turn-on capacitor 45 is a current generated by the discharge of the power supply capacitor 41*a*, and flows in a path with the flash discharge tube 24, the resistor 47, the resistor 49, the turn-on capacitor 45 and the current limiting resistor 41*b* and back to the power supply capacitor 41*a*. The power supply voltage Vab gradually rises with an increase in the power supply voltage VT across the turn-on capacitor 45.

When the discharge switching unit 44 becomes conductive, the turn-on capacitor 45 is discharged in a path including the resistor 49, the control transistor 51 being conductive, the discharge switching unit 44, and the resistor 58. A current generated by the discharge flows to the resistor 49. Thus, the on-voltage occurs across the resistor 49 at a level according to the current of the discharge and the resistance of the resistor 49.

The thyristor 46 as a non-contact switch has a gate and a cathode which are connected to ends of the resistor 49. An anode of the thyristor 46 is connected with a positive terminal of the main capacitor 23. The charging voltage across the main capacitor 23 is applied between the anode and cathode of the thyristor 46. An on-voltage is generated across the resistor 49 by discharge of the turn-on capacitor 45, and is applied between the gate and cathode of the thyristor 46 as a gate voltage.

The thyristor 46 is rendered conductive between an anode and cathode thereof when a gate voltage equal to or higher than a threshold level is applied thereto. In response to this, the main capacitor 23 comes to be discharged in a path with the anode and cathode of the thyristor 46 instead of the flash discharge tube 24, as the path with the anode and cathode being conductive has lower impedance than the flash discharge tube 24. Thus, flash emission is quenched.

To turn on the thyristor 46 as described above, a gate voltage of at least a predetermined level must be applied to the thyristor 46. The on-voltage generated across the resistor 49 must be at least the predetermined level. The on-voltage depends on highness of the current of discharge flowing in discharge of the turn-on capacitor 45. The current of discharge changes according to the discharge voltage that is the charging voltage at the time of starting discharging the turn-on capacitor 45. Consequently, it is necessary that the charging voltage VT across the turn-on capacitor 45 should be at least a predetermined voltage V2=4.0 volts at the time of turning on of the discharge switching unit 44 for the purpose of rendering the thyristor 46 conductive.

While the turn-on capacitor 45 is being charged and during occurrence of a drop in the voltage with a current flowing in the resistor 49, the charging voltage VT across the turn-on capacitor 45 is lower than the power supply voltage Vab. However, a drop in the voltage at the resistor 49 is very small when the control transistor 51 becomes conductive, namely when the power supply voltage Vab increases and reaches the voltage V1. So the charging voltage VT across the turn-on capacitor 45 is approximately the same as the voltage V1. Therefore, various factors and constants of the circuits are predetermined so as to determine the voltage V1 equal to or higher than the voltage V2. After the charged voltage VT of the turn-on capacitor 45 becomes at least the voltage V2, the control transistor 51 is rendered conductive to power the reflected light measuring unit 43. The thyristor 46 can be rendered conductive reliably.

In the turn-on capacitor 45, the charging voltage VT should come up to the voltage V2 before the integration voltage Vac comes up to the voltage V3. It may be conceivable to cause the charging voltage VT to become the voltage V2 or higher before the bypass transistor 52 is turned on and then turned off. However, the light adjusting circuit 25 is likely to become unstable in operation because of an inrush current flowing to the photo transistor 16 while the turn-on capacitor 45 is charged. It is preferable that the charging voltage VT across the turn-on capacitor 45 has become the voltage V2 or higher when the power supply voltage Vab comes up to the voltage V1.

Note that, in order to render the thyristor 46 conductive, it is necessary to apply a gate voltage equal to or higher than the predetermined level V2, and to supply a gate current equal to or higher than a predetermined value. So capacitance and other specifics of the turn-on capacitor 45 are prescribed suitably in order to supply sufficient gate current while the charging voltage VT across the turn-on capacitor 45 is V2 or higher.

The light adjusting circuit 25 is constructed to turn on the discharge switching unit 44 in considering the quench of the reflected light measuring unit 43 at an initial step of the flash emission by means of the light receiving control unit 42. This is for the purpose of optimizing a light amount of flash light in combination with an aperture stop of the lens-fitted photo film unit and photo sensitivity of the photo film in a manner irrespective of an object distance. For example, density of a filter disposed in front of the photo transistor 16 is changed to adjust photo sensitivity of the reflected light measuring unit 43 including the photo transistor 16.

In the above embodiment, the booster circuit 21 and the trigger circuit 22 have structures as described herein. However the booster circuit 21 and the trigger circuit 22 may have other structures for use with the main capacitor 23 and the flash discharge tube 24 of which the electrodes are connected with the terminals of the main capacitor 23.

The operation of the above construction is described now. To take an exposure with flash, the flash charger button 8 is pushed and slid to the on-position. The charger power switch 27 is responsively turned on to start the booster circuit 21. In operation of the booster circuit 21, a current output by the booster circuit 21 charges the main capacitor 23, the trigger capacitor 32, and the power supply capacitor 41*a* in the effective voltage generator 41.

When the main capacitor 23 is charged to a predetermined charging voltage, the LED 36 is driven to emit light. A user checks light at the LED 36, and then observes a photographic field through the viewfinder 5, and depresses the shutter release button 10 to take an exposure.

A shutter blade is opened and shut by depression of the shutter release button 10. When the shutter blade opens fully, the sync switch 33 is turned on to discharge the trigger capacitor 32. A trigger voltage is generated by the trigger transformer 34, and is applied to the flash discharge tube 24. The application of the trigger voltage causes breakdown between electrodes of the flash discharge tube 24, to discharge the main capacitor 23 in a path with the flash discharge tube 24. Flash emission of the flash discharge tube 24 is started. Flash light emitted from the flash discharge tube 24 is directed by the flash emitter 7 toward a photographic field.

Figure 4:
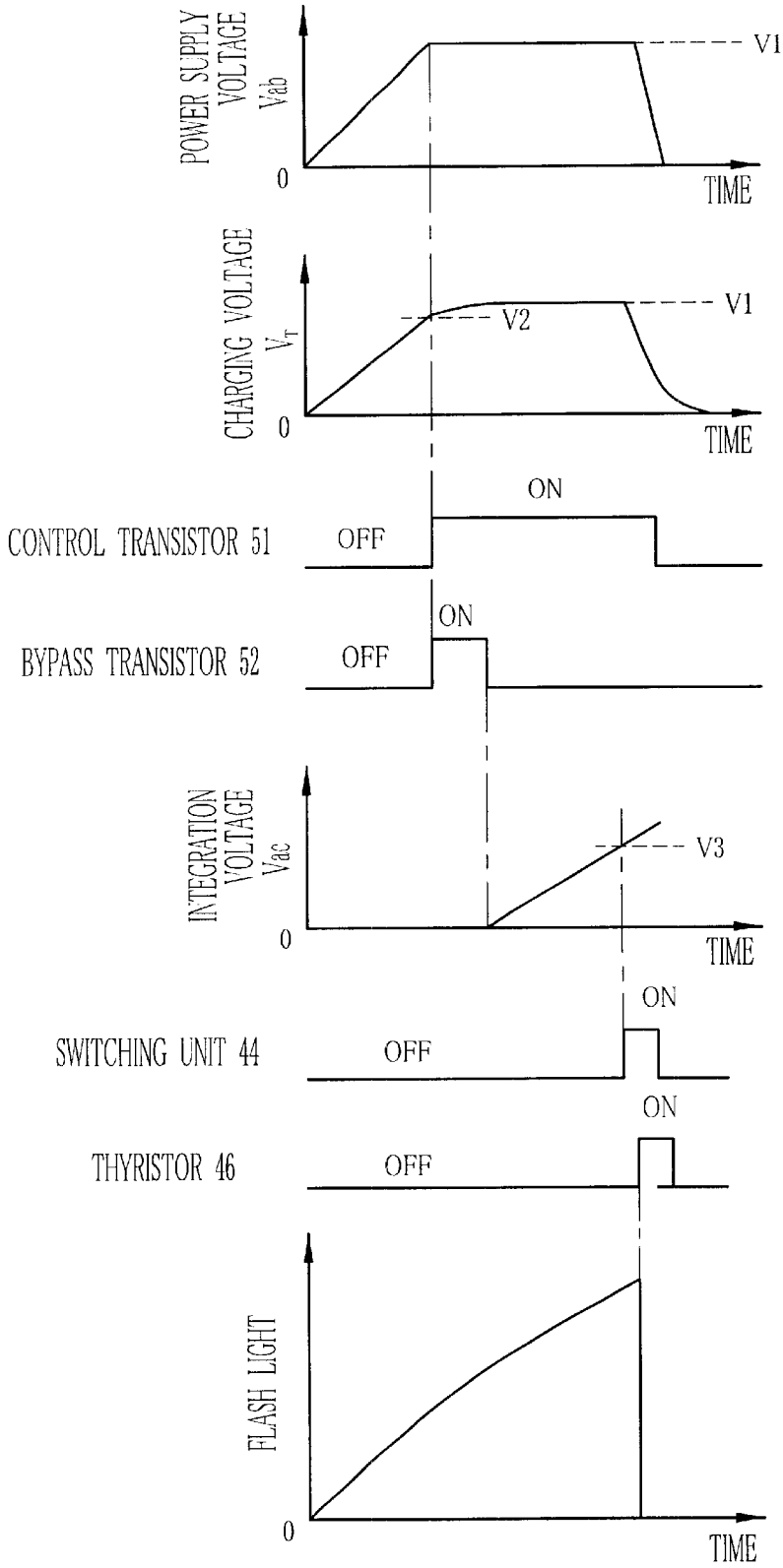
FIG. 4 is a timing chart illustrating waveforms of levels of voltages with states of transistors.

At the same time as the flash emission, the power supply capacitor 41*a* starts being discharged in a path with the flash discharge tube 24. A current from the power supply capacitor 41*a* flows in a path with the flash discharge tube 24, the resistor 47, the resistor 49, the turn-on capacitor 45 and the current limiting resistor 41*b*, to charge the turn-on capacitor 45. In FIG. 4, the power supply voltage Vab increases in the course of charging the turn-on capacitor 45. Note that a current from the power supply capacitor 41*a* partially flows into a path with the flash discharge tube 24, the resistor 47, the resistor 48 and the current limiting resistor 41*b*.

When the power supply voltage Vab comes up to the voltage V1, the control transistor 51 is rendered conductive. The voltage between the emitter and base becomes constant, for example 0.7 volt. A constant current flows across the resistor 51*a* in application of 0.7 volt. A current flowing across the Zener diode 41*c* becomes constant. A voltage across the Zener diode 41*c* is constant at the Zener voltage VZD. Therefore, the power supply voltage Vab is kept at the voltage V1, and does not become higher than the voltage V1.

When the power supply voltage Vab comes up to the voltage V1, the charging voltage VT across the turn-on capacitor 45 is nearly the same as the voltage V1, and naturally higher than the voltage V2. The charging voltage VT does not become equal to or higher than the voltage V1.

As the control transistor 51 becomes conductive, a collector current from the control transistor 51 flows in a path with the resistor 54, the capacitor 53 and the resistor 55. A voltage occurs across the resistor 55, to render the bypass transistor 52 conductive. Thus, the connection points Pa and Pc are short-circuited. Specifically, terminals of a serial circuit including the integration capacitor 43*a* and the near distance compensation resistor 43*b* are short-circuited.

On the other hand, flash light is applied to a photographic object, from which reflected light is partially passes through the light receiving window 9 and comes incident upon the photo transistor 16. However, no photoelectric current is output from the photo transistor 16 while the control transistor 51 is not conductive.

The control transistor 51 is turned on to apply the power supply voltage Vab to the collector of the photo transistor 16 in a path with the control transistor 51 and the resistor 54. A photoelectric current is output by an emitter of the photo transistor 16 according to a light amount of received reflected flash light. Immediately after application of the collector voltage, the emitter outputs an inrush current due to the collector output capacitance. However, no inrush current charges the integration capacitor 43*a*, because the bypass transistor 52 short-circuits the connection points Pa and Pc.

In charging the capacitor 53, the voltage across the resistor 55 comes down to a predetermined low level. The bypass transistor 52 becomes turned off. At this time, there occurs no inrush current due to the collector output capacitance of the photo transistor 16.

The bypass transistor 52 being turned off, the current output by the photo transistor 16 flows through the near distance compensation resistor 43*b* to the integration capacitor 43*a*. No inrush current occurs once the bypass transistor 52 is turned off. The integration capacitor 43*a* is charged by the photoelectric current according to a light amount of reflected flash light incident upon the photo transistor 16. The integration capacitor 43*a* effects integration of a light amount of the reflected flash light received by the photo transistor 16, to increase the integration voltage Vab. As the reflected light measuring unit 43 is supplied with the power supply voltage Vab kept at the voltage V1, the integration can be effected correctly.

While the flash emission continues, an integration value of the light amount at the photo transistor 16 increases. When the integration voltage Vac comes up to the threshold voltage V3, the discharge switching unit 44 is rendered conductive. In response to this, the turn-on capacitor 45 is discharged in a path with the resistor 49, the control transistor 51, the discharge switching unit 44 and the resistor 58. The on-voltage generated across the resistor 49 is supplied as a gate voltage of the thyristor 46.

The turn-on capacitor 45 has been charged at the charging voltage VT equal to or higher than the voltage V2 before the control transistor 51 becomes conductive. The discharging voltage, which is the charging voltage VT at the time of turning on the discharge switching unit 44, is the voltage V2 or higher. When the turn-on capacitor 45 is discharged by turning on of the discharge switching unit 44, the on-voltage occurs across the resistor 49 at a level sufficient for turning on the thyristor 46. The on-voltage is applied to the thyristor 46 as gate voltage that is the voltage V2 or higher. A gate current flows from the gate of the thyristor 46 to the cathode, to render the thyristor 46 conductive.

The anode and cathode of the thyristor 46 are now conductive. The main capacitor 23 is discharged by means of the thyristor 46 having the impedance lower than that of the flash discharge tube 24. The voltage across the flash discharge tube 24 becomes lower than a voltage level sufficient for maintaining the discharge. The discharge of the main capacitor 23 with the flash discharge tube 24 is discontinued, to quench the flash emission. After this, the current flowing in the thyristor 46 decreases and becomes equal to or lower than a predetermined level, to turn off the thyristor 46. When the thyristor 46 is turned on at first, the power supply capacitor 41*a* is discharged together with the main capacitor 23 by means of the thyristor 46.

The integration capacitor 43*a* is discharged and initialized in a path with the near distance compensation resistor 43*b* and the initialization resistor 43*c*. The capacitor 53 is discharged and initialized in a path with the resistors 54, 56 and 55. If flash light is emitted without turning on the thyristor 46, the turn-on capacitor 45 is discharged and initialized in a path with the resistors 49 and 48.

As is described heretofore, the photo transistor 16 in the light adjusting circuit 25 of the flash device is enabled by the control transistor 51 after the charging voltage VT across the turn-on capacitor 45 comes up to the voltage V2. If the object distance is small, or if the integration voltage Vac rises abruptly to the voltage V3 according to the reflectance of a principal object, the thyristor 46 reliably becomes conductive to quench the flash emission. As a result, there occurs no full emission of flash light if the distance to the principal object is small or if the reflectance of the principal object is very high.

There occurs a small delay after turning on the discharge switching unit 44 and before quenching the flash emission upon turning on the thyristor 46. However, the near distance compensation resistor 43*b* connected with the integration capacitor 43*a* compensates for the delay so that turning on of the discharge switching unit 44 is set early. There is no serious overexposure at the time of photography at a very near distance.

Also, the bypass transistor 52 is used, which is kept conductive for a sufficient time after applying collector voltage to the photo transistor 16. The bypass transistor 52 prevents an inrush current from flowing to the integration capacitor 43*a*. Therefore, the precision in the light adjustment can be high by removing influence of an inrush current. The integration for the light amount is effected after the power supply voltage Vab becomes constant. This is effective in keeping the precision.

Let a flash device lack the bypass transistor 52 unlike the present invention. An object distance may be not short but normal, so a user may wish full emission of flash light to photograph a scene. However, an inrush current is likely to charge the integration capacitor 43*a* to turn on the thyristor 46 in an unwanted manner. Also, an inrush current and a successive photoelectric current according to reflected flash light are likely to raise the integration voltage Vac to turn on the thyristor 46. Flash emission is accidentally quenched without full emission. However, the bypass transistor 52 is used in the present invention, so those problems are avoided.

Figure 5:
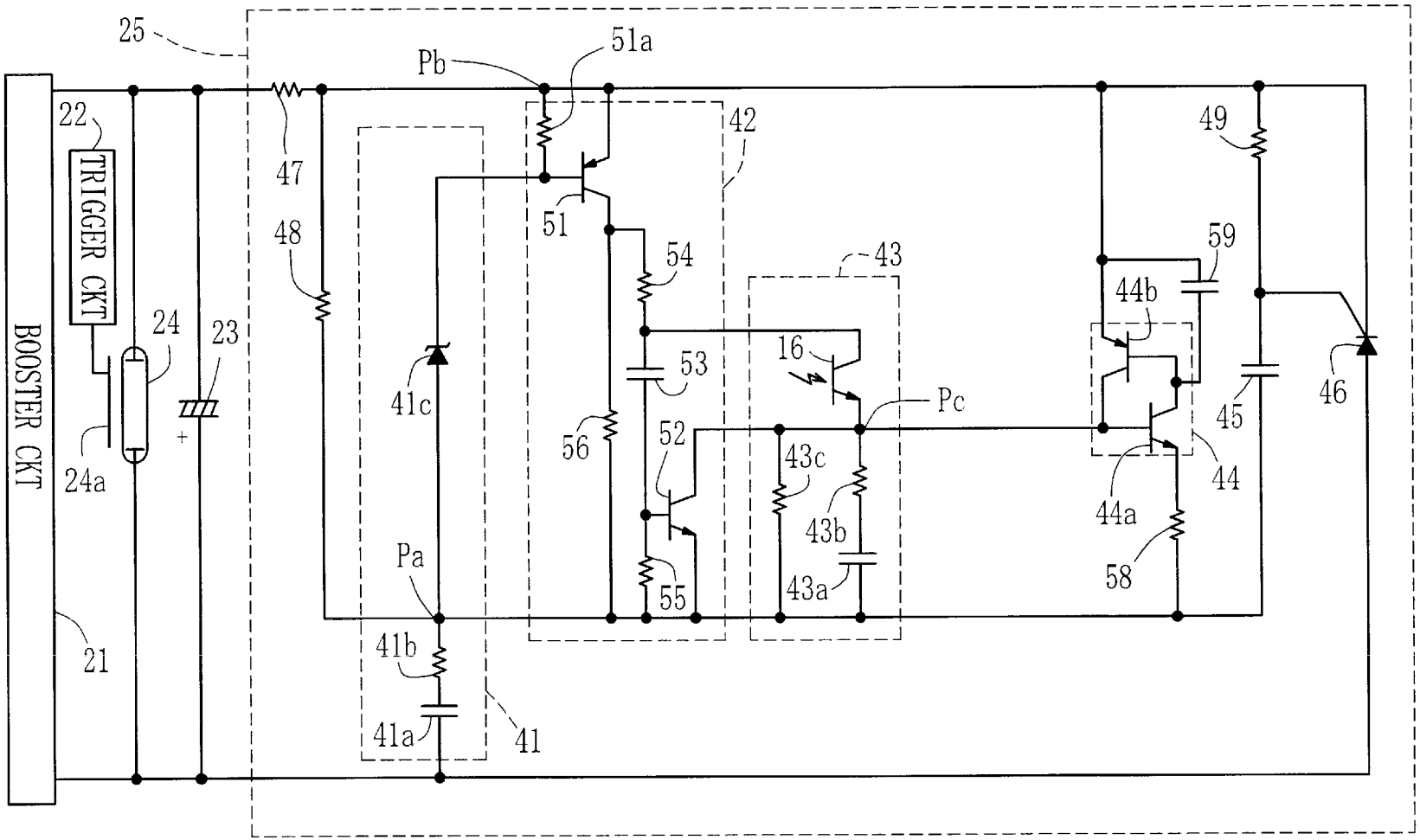
FIG. 5 is a block diagram illustrating an embodiment having a discharge switching unit connected in another preferred manner.

In FIG. 5, another preferred embodiment is depicted, in which a light adjusting circuit can operate with reliable stability. An emitter of the second transistor 44*b* of the discharge switching unit 44 is connected with the connection point Pb instead of being connected with the collector of the control transistor 51. The remaining portions of the embodiment are the same as those according to the above embodiment. Elements similar to those of the above embodiment are designated with identical reference numerals.

Should the turn-on capacitor 45 is discharged in a path with the control transistor 51, the power supply voltage Vab drops upon discharge of the turn-on capacitor 45. It is likely that the control transistor 51 is turned off and does not keep the discharge switching unit 44 turned on. However, it is possible in the invention to avoid those problems, because the emitter of the second transistor 44*b* is connected with the connection point Pb to discharge the turn-on capacitor 45 without a flow of a current in the control transistor 51.

Figure 6:
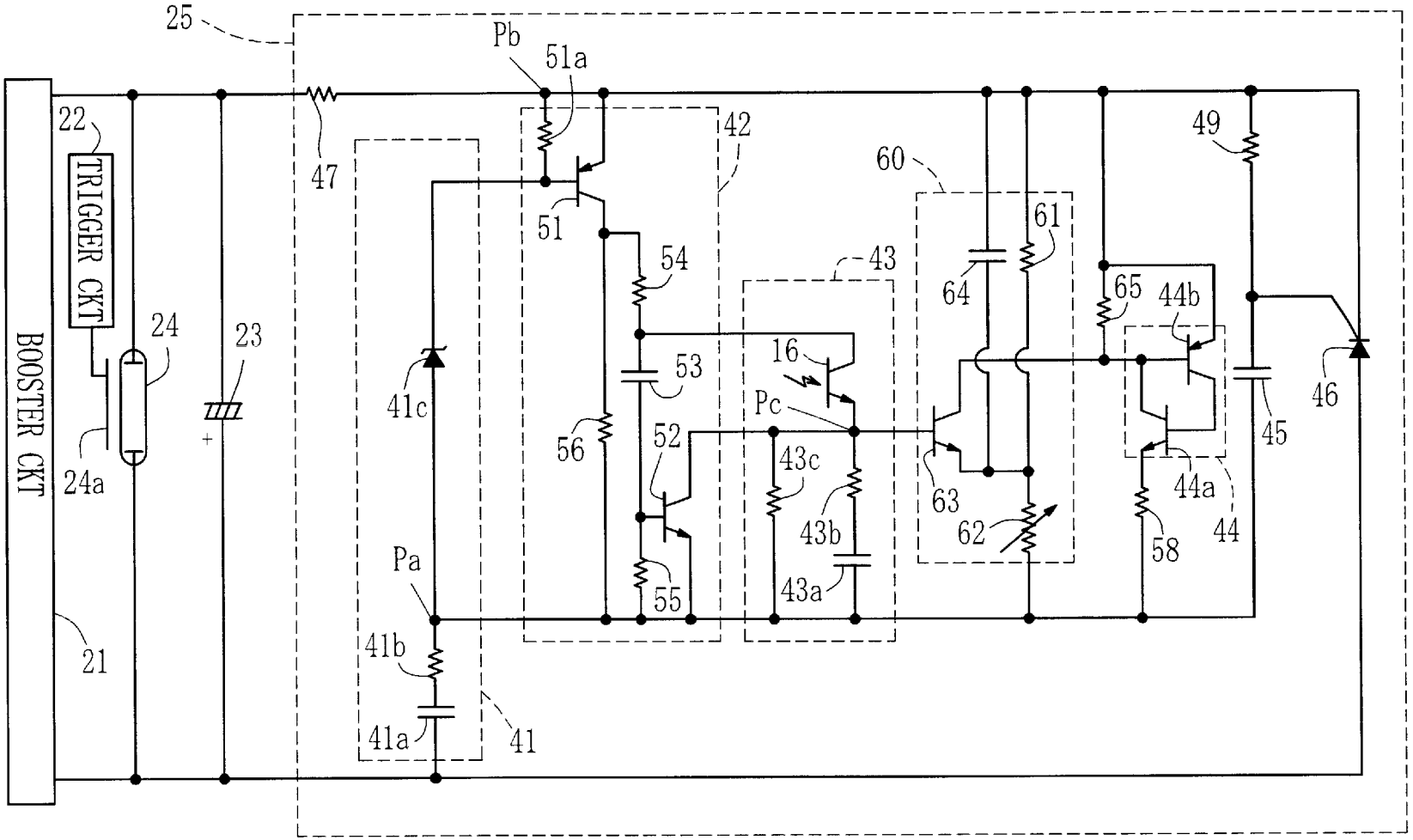
FIG. 6 is a block diagram illustrating a preferred embodiment having a level changer circuit with which an amount of light to be applied is settable.

In FIG. 6, still another preferred embodiment is illustrated, in which a circuit for changing a light adjusting level is added. Elements similar to those of the above embodiment are designated with identical reference numerals.

A level changer circuit 60 includes a first resistor 61, a variable resistor 62 and an adjustment transistor 63. The first resistor 61 and the variable resistor 62 constitute an offset voltage generator for generating an offset voltage for determining an input voltage for rendering the adjustment transistor 63 conductive. The first resistor 61 has a first end portion connected with the connection point Pb, and a second end portion connected with a first terminal of the variable resistor 62. A second terminal of the variable resistor 62 is connected with the connection point Pa. Resistance of the variable resistor 62 is variable.

The adjustment transistor 63 is an n-p-n transistor, has a base connected with the connection point Pc, an emitter connected with a connection point between the first resistor 61 and the variable resistor 62. A noise absorbing capacitor 64 prevents the adjustment transistor 63 from becoming conductive upon occurrence of electrical noise, and is connected between the emitter of the adjustment transistor 63 and the connection point Pb that is a positive line for application of the power supply voltage Vab. In comparison with the first embodiment of FIG. 3, the resistor 48 for initializing the turn-on capacitor 45 is omitted, because the first resistor 61 and the variable resistor 62 are connected between the connection points Pa and Pb.

The first transistor 44*a* of the discharge switching unit 44 has a collector connected with a base of the second transistor 44*b* and connected with a collector of the adjustment transistor 63. Also, the first transistor 44*a* is connected with the connection point Pb by a resistor 65. The first transistor 44*a* has a base connected with a collector of the second transistor 44*b*, and has an emitter connected with the connection point Pa by the resistor 58. An emitter of the second transistor 44*b* is connected with the connection point Pb.

According to the above embodiment, the power supply voltage Vab is divided by the first resistor 61 and the variable resistor 62. An offset voltage occurs between terminals of the variable resistor 62. In the adjustment transistor 63, an input voltage is applied between the base and emitter at a level of a difference obtained by subtracting the offset voltage from the integration voltage Vac. When the integration voltage comes up to a threshold voltage, the adjustment transistor 63 is rendered conductive.

As the adjustment transistor 63 is turned on, the base of the second transistor 44*b* becomes connected with the connection point Pa in a path with the adjustment transistor 63 and the variable resistor 62. The second transistor 44*b* becomes conductive because a potential of the base drops. Turning on of the second transistor 44*b* causes a current to flow to a base of the first transistor 44*a* in a path with an emitter and collector of the second transistor 44*b*. The first transistor 44*a* is rendered conductive. Thus, the base of the second transistor 44*b* becomes connected with the connection point Pa in a path with the first transistor 44*a* and the resistor 58. Even though the adjustment transistor 63 is turned off, a current flows to the base of the second transistor 44*b* to keep the second transistor 44*b* turned on. The discharge switching unit 44 including the first and second transistors 44*a* and 44*b* is kept turned on.

The discharge switching unit 44 being turned on, the turn-on capacitor 45 is discharged in a path with the resistor 49, the discharge switching unit 44 and the resistor 58. The thyristor 46 is rendered conductive, to quench the flash emission.

The offset voltage is increased or decreased according to changes in the resistance of the variable resistor 62. When the integration voltage Vac is output, the power supply voltage Vab is kept at the voltage V1. So the offset voltage is determined according to the resistance of the variable resistor 62.

In conclusion, the prescribed level of the integration voltage Vac for quenching the flash emission can be changed by adjusting the resistance of the variable resistor 62. The light adjusting level can be determined easily and with high precision. Also, the variable resistor 62 can be set to optimize the exposure without using a filter. No filter is required in front of the photo transistor 16. No filters of plural types are required for various values of density.

Figure 7:
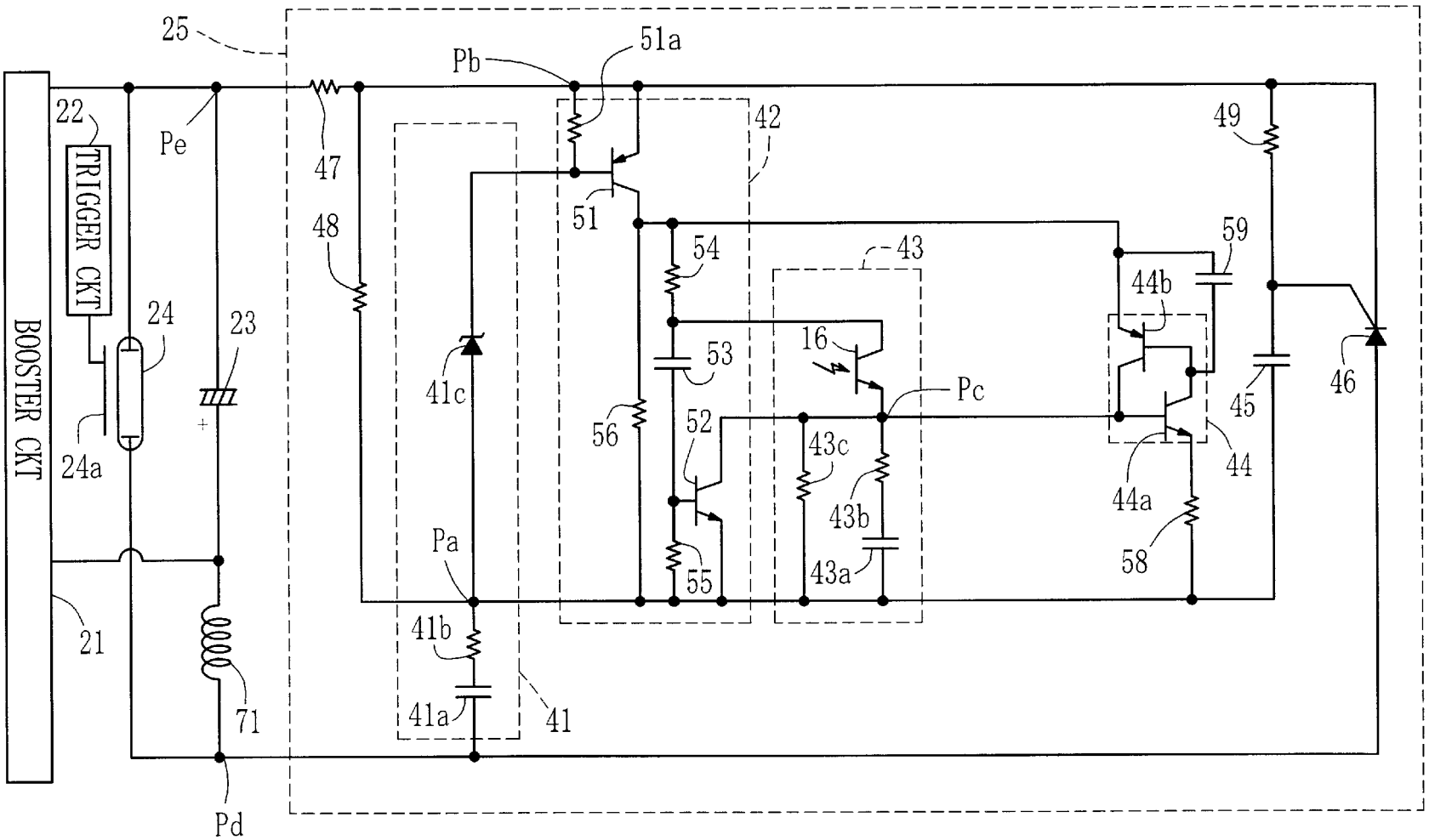
FIG. 7 is a block diagram illustrating a preferred embodiment having a choke coil for high precision in the light adjustment.

In FIG. 7, a preferred embodiment is illustrated, in which a choke coil is used for raising precision in the light adjustment, shortening time for charging the turn-on capacitor 45, and protecting the thyristor. Portions of the embodiment except for the choke coil are the same as the above embodiments. Elements similar to those of the above embodiments are designated with identical reference numerals.

In FIG. 7, a choke coil 71 is connected between a positive terminal of the main capacitor 23 and the flash discharge tube 24. One terminal of the power supply capacitor 41*a* in the effective voltage generator 41 and an anode of the thyristor 46 are connected with the connection point Pd where the choke coil 71 is connected with the flash discharge tube 24. A reference sign Pe designates a connection point where a negative terminal of the main capacitor 23 is connected with the flash discharge tube 24.

In the process of charging the main capacitor 23, a current output by the booster circuit 21 is supplied directly to the main capacitor 23. The current output by the booster circuit 21 is supplied to the power supply capacitor 41*a* via the choke coil 71 to charge the power supply capacitor 41*a*. In completion of the charging, the changing voltage across the main capacitor 23 and the power supply capacitor 41*a* is commonly 300 volts.

Note that a current output by the booster circuit 21 can be supplied to the main capacitor 23 via the choke coil 71 in order to charge the main capacitor 23. A current output by the booster circuit 21 can be supplied to the power supply capacitor 41*a* directly to charge the power supply capacitor 41*a*.

Figure 8:
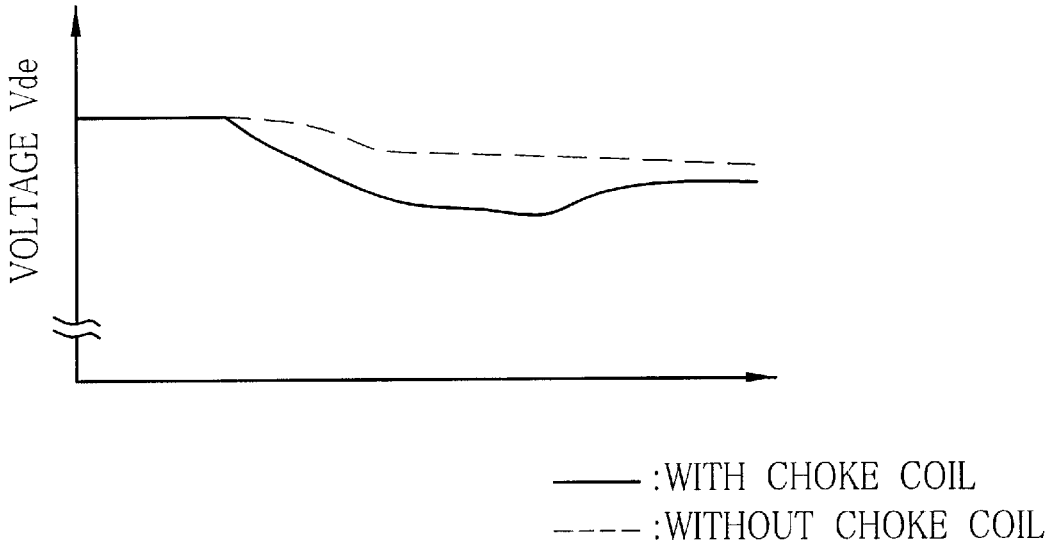
FIG. 8 is a graph illustrating curves of voltages for structures with and without the choke coil.

When the trigger voltage is applied to the flash discharge tube 24, a current starts flowing from the main capacitor 23 in a path with the choke coil 71. With the start of the flow of the current, a voltage occurs in a direction to obstruct a flow of the discharging voltage in the choke coil 71. The voltage Vde between the connection points Pd and Pe drops from the charging voltage of 300 volts to 200 volts instantaneously. See FIG. 8 for the curve in the solid line. Note that the broken line in FIG. 8 indicates the voltage Vde in a structure without the choke coil 71.

Note that a second series is connected in parallel with a first series, the first series including the power supply capacitor 41*a*, the current limiting resistor 41*b*, the Zener diode 41*c* and the control transistor 51 with the resistor 51*a* in parallel, the second series including the main capacitor 23 and the choke coil 71. Accordingly, the voltage Vda as a potential difference between the connection points Pa and Pd is kept near to the voltage Vde as a potential difference across the second series or between the connection points Pe and Pd, except for a small potential difference due to the parallel connection of the Zener diode 41*c* and the control transistor 51. The first and second series are kept substantially the same even with the small potential difference.

To shorten the time for charging the turn-on capacitor 45, the voltage across the second series described above should be substantially equal to a voltage across a series including the current limiting resistor 41*b* and the power supply capacitor 41*a*. In consideration of keeping the power supply voltage Vab lower than a predetermined level, it is effective to use the first and second series connected in parallel with each other in FIG. 7.

Figure 9:
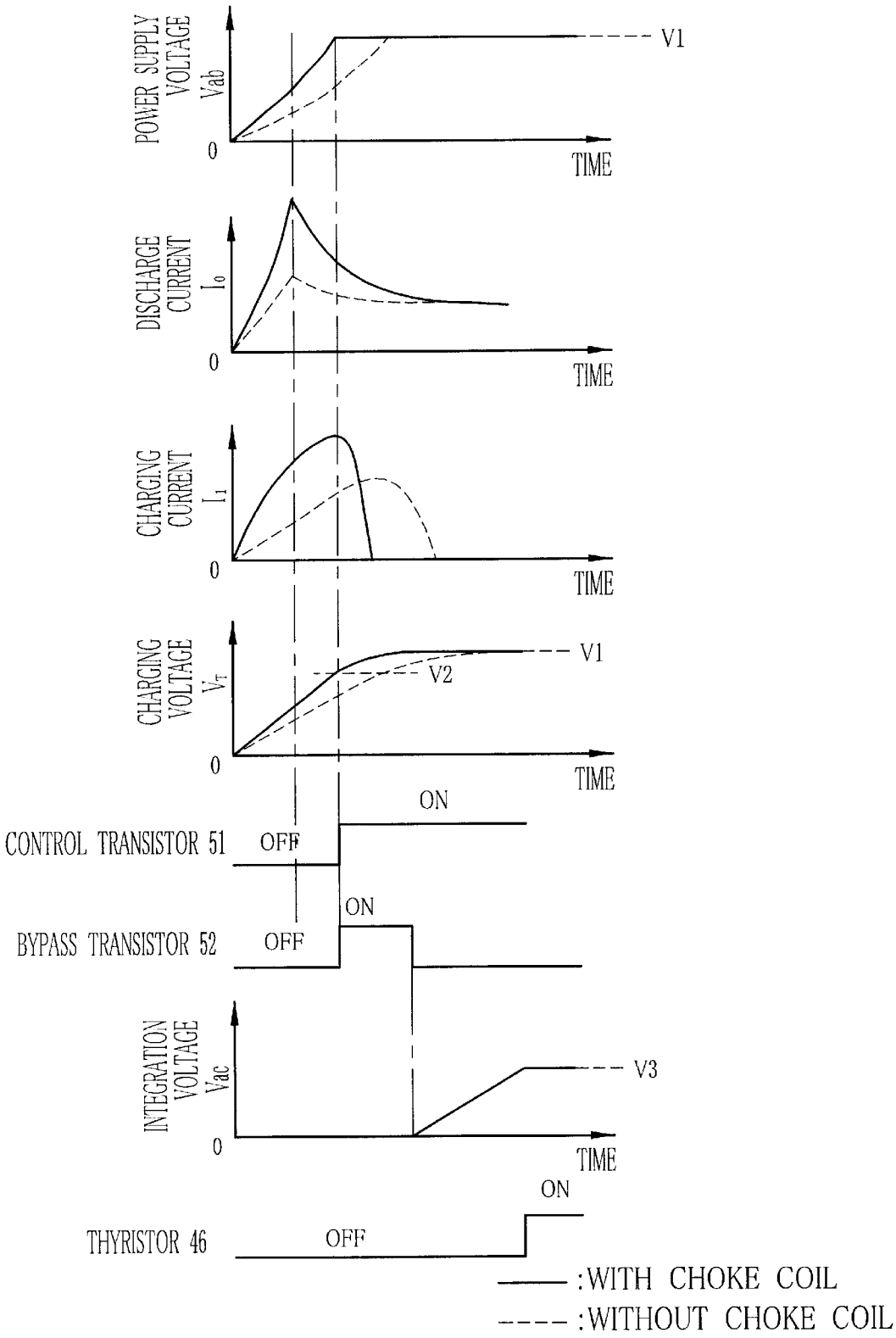
FIG. 9 is a timing chart illustrating waveforms of levels of voltages with states of transistors.
Figure 10:
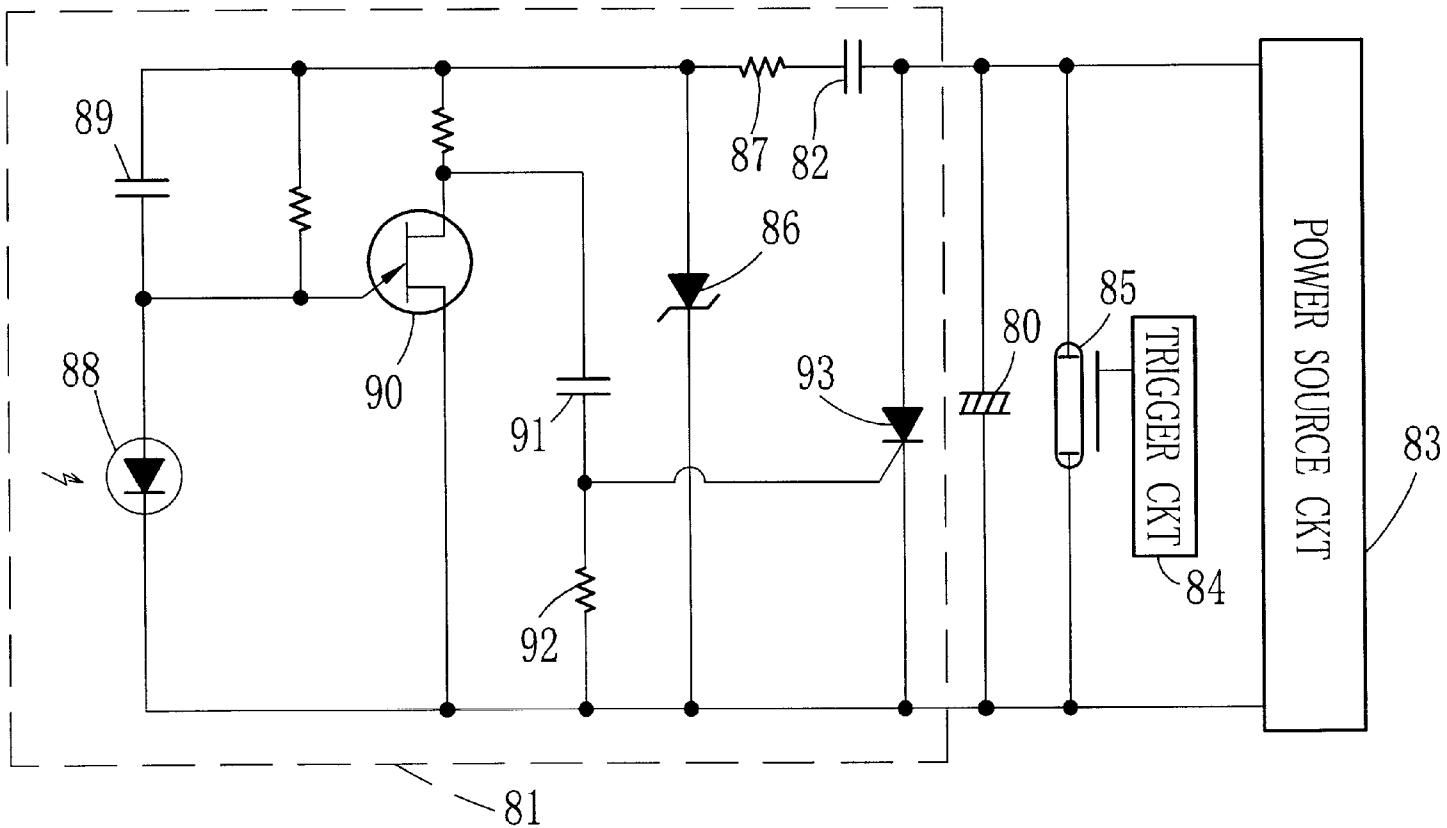
FIG.10 ( PRIOR ART )
FIG. 10 is a block diagram illustrating an electronic flash device according to the prior art.

As the voltage Vda is the same as voltage Vde, the voltage Vda drops from 300 volts to 200 volts instantaneously if the voltage Vde drops at one moment. Upon the drop of the voltage Vda, the voltage Vda which is lower than the charging voltage of the power supply capacitor 41*a* becomes applied to the power supply capacitor 41*a* in a path with the current limiting resistor 41*b*. In FIG. 9, discharge occurs for a short time to maintain the charging voltage equal to the voltage Vda, as indicated by the solid line. A current $I_0$ of the discharge abruptly increases, and becomes high. In FIG. 9, the broken line indicates a value at the time when no choke coil is used.

Most of the discharging current $I_0$ flowing from the power supply capacitor 41*a* being discharged flows as a charging current $I_1$ which charges the turn-on capacitor 45 in a path with the flash discharge tube 24 and the resistors 47 and 49. The discharging current $I_0$ increases quickly and comes up to a high level. According to this, the charging current $I_1$ becomes high. The voltage across the turn-on capacitor 45 quickly comes up to the voltage V2.

The charging of the turn-on capacitor 45 is effected quickly. So the power supply voltage Vab comes up to the voltage V1 even after a short time, to render the control transistor 51 conductive. Time required for the turn-on capacitor 45 to have the voltage V2, or time for rendering the control transistor 51 conductive is determined according to constants of the circuits. For example, the value of the time is 5–10 $\mu$sec. after the start of the flash emission. After the control transistor 51 becomes conductive, the bypass transistor 52 is turned on and then turned off. Thus, the reflected light measuring unit 43 starts receiving light.

This being so, the use of the choke coil 71 makes it possible to shorten the time required for charging the turn-on capacitor 45 up to the voltage V2 enough for turning on the thyristor 46, in comparison with the construction without the choke coil 71. The control transistor 51 can be turned on earlier. It is possible to set a short time for disabling the reflected light measuring unit 43 after starting the flash emission. Precision in adjusting flash light can be high specifically at a very near distance of a photographic object.

At the time of flash emission, the choke coil 71 suppresses abrupt increase of a current flowing from the main capacitor 23 to the battery 26. Thus, there is no quick increase in intensity of flash light in an initial step of the flash emission. Even though the integration of the light amount is started at the reflected light measuring unit 43 with a small delay, there is only a small difference between the actual light amount and a light amount obtained according to the integration. Because of this and the above-described short stop of the reflected light measuring unit 43, the precision in the light adjustment can be high. Furthermore, there is only a small amount of flash light emitted after turning on the discharge switching unit 44 and before turning on the thyristor 46. Therefore, the light adjustment can be the more precise.

The integration voltage Vac increases to turn on the discharge switching unit 44. In response, the thyristor 46 becomes conductive. The main capacitor 23 is discharged in a path with the thyristor 46. The current flows in the choke coil 71 in the process of the discharge. As a result, the choke coil 71 suppresses a quick increase in the discharging current from the main capacitor 23 to the thyristor 46. The thyristor 46 can be protected from degradation or destruction.

It is to be noted that, in use of the choke coil 71, a discharging current $I_0$ of a comparatively high level is caused to flow from the power supply capacitor 41*a*. It is likely, however, that a current flows between the emitter and collector of the control transistor 51 at the highest level at which a current can flow from the power supply capacitor 41*a* because of restriction with the current limiting resistor 41*b*. The light adjusting circuit 25 is likely to operate unstably. However, the problem of instability of the light adjusting circuit 25 occurs only after the control transistor 51 becomes conductive. Consequently, it is necessary even in use of the choke coil 71 to adjust constants of circuits, namely adjust the current limiting resistor 41*b*, the resistor 54, the capacitor 53 and the choke coil 71, for the purpose of suppressing a flow of a discharging current $I_0$ slightly short of its limited value after the control transistor 51 becomes conductive. Also, it is necessary to raise capacitance of the power supply capacitor 41*a*.

In the present embodiment, the choke coil 71 is added to the flash device in compliance with the first of the embodiments of the invention. However, it is possible in the invention to use the choke coil 71 in the flash devices according to FIGS. 5 and 6.

In FIGS. 3, 5 and 7, the noise absorbing capacitor 59 is used for preventing errors in operation due to electric noise. However, a resistor may be used instead of the noise absorbing capacitor 59.

In the above embodiments, the thyristor 46 is used as non-contact switch. However, other types of switching elements may be used as non-contact switch for the purpose of quenching the flash emission. Also, the control transistor 51, the bypass transistor 52 and the adjustment transistor 63 may be other switching elements, such as FETs (field-effect transistors). The above-described flash device is incorporated in the lens-fitted photo film unit. However, a flash device of the invention may be incorporated in a camera, or externally attached to a camera.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. An electronic flash device of an automatic light adjusting type, including a main capacitor for storing charge at a high voltage, a flash discharge tube for generating flash light with a current upon discharging said main capacitor, and a light adjusting circuit for adjusting a light amount of said flash light, wherein said light adjusting circuit includes:

a reflected light measuring unit for outputting an integration voltage for representing a light amount of reflected light from a photographic field illuminated with said flash light;

a non-contact switch for short-circuiting terminals of said main capacitor upon being turned on, to quench emission of said flash light in said flash discharge tube;

a turn-on capacitor for being charged in response to said emission of said flash light, and for being discharged when said integration voltage comes up to a prescribed level, to turn on said non-contact switch upon a pulse of discharge; and a control switching element for keeping said reflected light measuring unit disabled while said turn-on capacitor is initially charged, and for enabling said reflected light measuring unit after voltage across said turn-on capacitor comes up to a predetermined level.

2. An electronic flash device as defined in claim 1, further comprising a discharge switching unit for being turned on when said integration voltage from said reflected light measuring unit comes up to said prescribed level, to discharge said turn-on capacitor.

3. An electronic flash device as defined in claim 2, wherein said reflected light measuring unit includes:

a photo transistor, supplied with electric power by said control switching element, for outputting a photoelectric current according to intensity of said reflected light incident thereon; and an integration capacitor for integration of said photoelectric current to output said integration voltage.

4. An electronic flash device as defined in claim 3, further comprising a bypass switching element for being turned on in response to becoming conductive of said control switching element, and for short-circuiting terminals of said integration capacitor until lapse of a predetermined time, to inhibit charging with said photoelectric current.

5. An electronic flash device as defined in claim 4, wherein said bypass switching element is a bypass transistor, having a collector and emitter connected in parallel with said integration capacitor, and a base connected with said control switching element;

further comprising a capacitor connected between said base of said bypass transistor and said control switching element, and adapted for determining said predetermined time at which on-voltage is applied to said base of said bypass transistor.

6. An electronic flash device as defined in claim 2, wherein said reflected light measuring unit includes a near distance compensation resistor, connected in series with an integration capacitor, for constituting a serial circuit, to correct said integration voltage if said integration voltage increases slowly and highly, said serial circuit generating a voltage which is said integration voltage.

7. An electronic flash device as defined in claim 4, further comprising an effective voltage generator for outputting increasing power source voltage when said main capacitor is discharged;

said turn-on capacitor is supplied with said power source voltage, and charged.

8. An electronic flash device as defined in claim 7, wherein said effective voltage generator includes:

a power supply capacitor, connected in parallel with said main capacitor and said flash discharge tube, for being charged and discharged together with said main capacitor, said power supply capacitor outputting an increasing power supply voltage upon being discharged; and a Zener diode, connected in series with said power supply capacitor, for limiting said power supply voltage from said power supply capacitor to at least a predetermined effective voltage;

when said increasing power supply voltage comes up to said predetermined effective voltage, said control switching element is rendered conductive in response to an output of said Zener diode, for applying said power supply voltage to said reflected light measuring unit.

9. An electronic flash device as defined in claim 8, wherein said non-contact switch is a thyristor having an anode and cathode connected with respectively electrodes of said flash discharge tube, and having a gate connected with said turn-on capacitor.

10. An electronic flash device as defined in claim 8, further comprising a current limiting resistor, connected between said power supply capacitor and said Zener diode, for limiting a current from said power supply capacitor.

11. An electronic flash device as defined in claim 8, wherein one terminal of said power supply capacitor is connected with one terminal of said main capacitor at a first connection point;

said Zener diode is connected in parallel with said turn-on capacitor;

further comprising a choke coil, connected between said main capacitor and said first connection point, for constituting a first serial circuit with said main capacitor, wherein a current flows in said choke coil during said flash emission of said flash discharge tube by discharging said main capacitor, there occurs back electromotive force in said choke coil, for lowering a voltage between terminals of said first serial circuit, and for lowering a voltage between terminals of a second serial circuit including said power supply capacitor and said Zener diode, to discharge said power supply capacitor to charge said turn-on capacitor.

12. An electronic flash device as defined in claim 2, further comprising a level changer for setting said prescribed level variable for said integration voltage, to determine said light amount of said flash light to be emitted before quench.

13. An electronic flash device as defined in claim 12, wherein said level changer includes:

an offset voltage generator, including a first resistor and a variable resistor connected in series therewith, for generating an offset voltage by dividing said power supply voltage according to resistance of said variable resistor;

an adjustment transistor, supplied with input voltage, for becoming conductive when said input voltage comes up to a predetermined voltage, said input voltage being lower than said integration voltage by said offset voltage.

14. An electronic flash device as defined in claim 13, wherein said adjustment transistor has a collector and emitter one of which is supplied with said offset voltage;

further comprising:

an effective voltage generator for applying said power supply voltage to said light adjusting circuit;

a capacitor, connected with said one of said collector and emitter in parallel with said effective voltage generator and said first resistor, for absorbing electric noise to prevent said adjustment transistor from erroneously becoming conductive.

* * * * *